United States Patent [19]

Baines

[11] Patent Number: 5,018,241

[45] Date of Patent: May 28, 1991

[54] FOOT-OPERATED DOOR STOP ASSEMBLY

[76] Inventor: Richard M. Baines, 51 Sentry Dr., SE., Cartersville, Ga. 30120

[21] Appl. No.: 424,865

[22] Filed: Oct. 20, 1989

[51] Int. Cl.[5] ..... E05F 05/06

[52] U.S. Cl. ..... 16/82; 292/DIG. 15

[58] Field of Search ..... 16/82; 292/DIG. 15

[56] References Cited

U.S. PATENT DOCUMENTS

| | | | |
|---|---|---|---|
| 2,929,647 | 3/1960 | Gladstone | 16/82 |
| 3,330,585 | 7/1967 | Pollin | 292/DIG. 15 |
| 4,343,500 | 8/1982 | Steiner | 292/DIG. 15 |
| 4,462,623 | 7/1984 | Grant | 16/82 |

FOREIGN PATENT DOCUMENTS

| | | | |
|---|---|---|---|
| 111034 | 6/1984 | European Pat. Off. | 16/85 |

*Primary Examiner*—Richard K. Seidel
*Assistant Examiner*—Carmine Cuda
*Attorney, Agent, or Firm*—Thomas, Kerr & Kayden

[57] ABSTRACT

The security device of the present invention is secured to the floor of a structure adjacent the hinge side of a door to be made secure. The security device has an element which can be elevated by foot from its storage position to engage against the inner face of the door to prevent the door from being opened beyond a minimum amount and then can be depressed by foot to allow for normal usage of door.

8 Claims, 1 Drawing Sheet

FOOT-OPERATED DOOR STOP ASSEMBLY

BACKGROUND OF THE INVENTION

The prior co-pending application was rejected due to material which was set forth in the specifications but was not at first presented in the claims.

This oversight has been corrected and the present application is now submitted to better represent the present invention.

The present invention conceived in a dream and relates to an improved and useful means of being able to answer a door or leaving a door "ajar" without the fear of forced entry.

This device can be operated by foot and is attractive from the inside and undetectable from the outside. Said device provides as its objectives to be easily installed, sturdy in use and capable of resisting all attempts to reach and disengage said device from intruders.

As of present the main method of securing a door when opened and "ajar" is the use of a chain device. This device is visibly attached to the door and the chain can be cut by a pair of bolt cutters or otherwise torn out of the door by the use of extreme force.

There are some other foot operated door stops, but because of their rectangular shape they are difficult to install. A saw has to be used to cut the hole and a person would have to have skill or feel comfortable using same. These other devices have stopping members that are horizontally stored and it requires a bigger hole cut in the floor to store them, thus being more unsightly on top of the floor. Effort must also be used in cutting the hole to the proper size and positioning these devices at the proper angle to the door.

The present invention has for its stopping member a vertical shaft which is stored also vertically in a cylinder making it necessary to drill only a small hole to insert the storage cylinder through. Said hole would be drilled by the novice, who would use a drill equipped with a butterfly bit or hole saw, making the installation virtually mistake free.

There is no need for additional cutting in the floor since the latch is of a low profile and is located between the face of the top plate and the floor, said space being created by a downward flange around the outer edge of the top plate.

The stopping member can also be locked in an up position to prevent it from being pressed down by a stick or other object if there is a window close to the door that would be broken out by a would be intruder.

The present invention also has for its advantages its simplicity and number of parts required in manufacturing, thus saving cost.

With the above results and objectives in view, this new and useful device consists of the novel features of construction and arrangement of parts, hereafter fully described.

SUMMARY OF THE INVENTION

The present invention is a simple but most effective means of securing a door after it is "ajar". Said invention allows door to be opened a minimum amount so that the person outside the door may be seen and talked with without permitting his entrance.

The present invention is sturdily made and is rugged in use having a top plate which is fastened on top of the floor and has a chamber which passes though a small hole in the floor.

The present invention has a stopping member which rises when so desired by the moving of a latching member. Said stopping member is retracted back into its chamber and out of the path of the doorway by pressing it down by foot.

Other objectives and advantages will become apparent in the following specifications, when considered in light of the attached drawing.

DETAILED SPECIFICATIONS

Referring in detail to the perspective drawings wherein similar parts of the present invention or device 10 are identified by like reference numbers.

Figure 1:
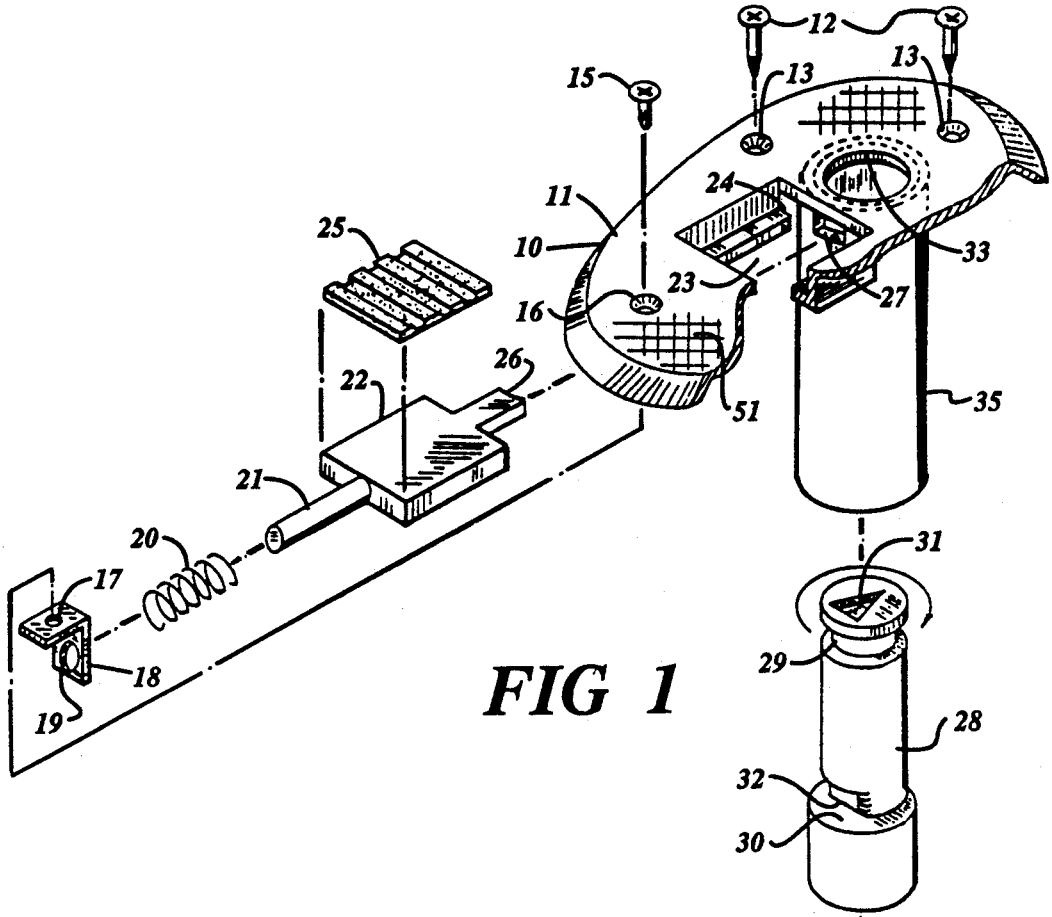
FIG. 1 is an exploded perspective view of the present invention showing its parts and how they relate to each other and floor opening.

FIG. 1 shows said device 10 in a perspective mode comprising a face plate 11 and anchor screws 12 which are inserted through holes 13 to fasten to floor 14. A self-threading screw 15 is inserted through hole 16 and then screwed into hole 17 which secures "L" shaped bracket 18. Bracket 18 has an aperture 19 that shaft 21 is inserted through, thus keeping spring 20 on shaft 21 while supporting latch 22 and holding it in place. Spring 20 keeps forward tension on latch 22 so as to make latch 22 engage stopping member 28, thus holding stopping member 28 in its different modes.

Latch 22 is visibly seen and operated by contact through aperture 23. Aperture 23 has two downward supporting arms 24, one on each side, to support latch 22. Latch 22 has an adhesive backed, rubber top surface 25 for insuring a slip free surface when moving with toe of shoe or foot.

Latch 22 has a forward key 26 which is inserted through aperture 27 having forward pressure kept on it by spring 20, and key 26 works back and forth making contact with stopping member 28 controlling the position and mode of stopping member 28 when stopping member 28 is down and out of the way of the door, key 26 is in slot 29 holding it down and stopping the upward thrust of stopping member 28.

Stopping member 28 is rotatable to allow key 26 to enter slot 32 thus locking stopping member 28 in an up position. An arrow 31 is located on top of stopping member 28 and indicates when stopping member 28 is locked in an up position or not. When stopping member 28 is rotated to a non-locked up position said stopping member 28 can be depressed by simply stepping on it since key 26 is in no slot.

Face plate 11 has an aperture 33 which allows stopping member 28 to pass back and forth to stop door 34. Aperture 33 being of a size to accept stopping member 28 down to shoulder 30. Shoulder 30 is slightly smaller than the inside diameter of the cylinder 35, thus being movable but snug giving stability and strength to device 10.

Upward pressure is kept on stopping member 28 by spring 36 at all times, said compression spring 36 being held in cylinder 35 by plug 37 which is inserted into bottom of cylinder 35.

Figure 2:
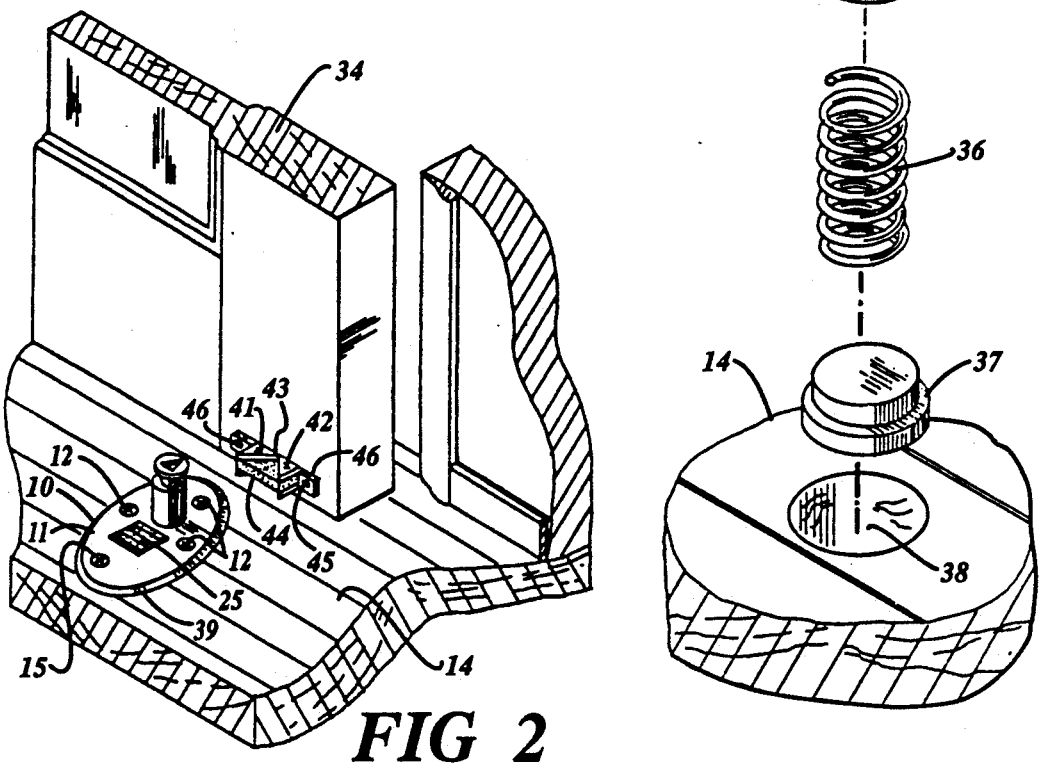
FIG. 2 is a perspective view of the present invention and its intallation in relationship to the floor and door.

Vertical cylinder 35 is inserted through a round hole 38 in floor. Device 10 is held in place by screws 12 as seen in FIG. 2. Lip 39 is used to cover edge of flooring materials 47 and to allow for sufficient space between face plate and floor for latch 22 without being recessed in floor 14, thus eliminating additional cutting in said floor 14 other than a round hole 38 to receive cylinder 35.

Device 10 is set to the side of a door opening 40 and is cross hatched 51 to provide a slip resistant surface to protect against slipping if stepped on.

A door striking guard 41 is secured to door 34 to prevent damage to door 34 and to minimize unnecessary stress to device 10 when struck by door, said guard 41 consisting of a channel 42 with two "v's" 43 one on top and one on the bottom allowing a rubber pad 44 to be struck without striking channel 42. Said channel is connected at both ends by screws 45 secured through holes in side tabs 46.

I claim:

1. A foot-operated door stop assembly for installation in a vertically disposed hole in a floor on the side to which the door opens, said assembly comprising a cylindrical housing disposed in the hole and having an open upper end, an elevated face plate projecting radially from said cylindrical housing and being adapted to engage the floor surface, a door stopping member disposed in said housing and having upper and lower slot means formed in the outer surface thereof, a latch assembly means spaced outwardly from said stopping member and being horizontally movable for selectively engaging one of said slot means for maintaining said door stopping member in a selected position, said latch assembly means being disposed above the level of the floor and below said elevated face plate, said door stopping member being rotatably mounted in said housing for selectively aligning said lower slot means with said latch assembly means and a spring means disposed below said stopping member for urging said member upwardly upon disengagement of said latch assembly means from said upper slot means.

2. A foot-operated door stop assembly as defined in claim 1 in which said face plate includes a downwardly projecting lip for engaging the floor and elevating said face plate.

3. A foot-operated door stop assembly as defined in claim 1 in which said slotted stopping member is rotatable 360° for engagement and disengagement of said lower slot means with said latch assembly means.

4. A foot operated door stop assembly for installation in a hole in a floor on the side to which the door opens, said stop assembly comprising a vertically disposed stopping member having a raised position for engagement with the door and a lowered position wherein the upper portion of said stopping member is below the lowermost edge of the door, spring means disposed below said stopping member for urging said member to said raised position, upper and lower slot means formed in said stopping member, a latch assembly means spaced outwardly from said stopping member and mounted for horizontal movement for selectively engaging said slot means for maintaining said stopping member in a selected position until said latch assembly means is disengaged from said slot means, said latch assembly means including a biasing means for urging said latch assembly means toward said stopping member and engaging one of said slots, the engagement of said latch assembly means with said upper slot serving to lock said stopping member in a lowered position and the engagement of said latch assembly means with said lower slot serving to lock said stopping member in raised position, said stopping member also being rotatably mounted for disengaging said latch assembly means from said lower slot means.

5. A foot-operated door stop assembly as defined in claim 4 in which said lower slot is formed on a side of said stopping member.

6. A foot-operated door stop assembly as defined in claim 4 in which said vertical stopping member is marked on the uppermost end thereof with an arrow pointing toward the door when said latch assembly means is engaged with said lower slot.

7. A foot-operated door stop assembly for installation in a vertically disposed hole in a floor on the side to which the door opens, said assembly comprising a cylindrical housing disposed in the hole and having an open upper end, a door stopping member disposed in said housing and having upper and lower slot means formed in the outer surface thereof, a latch assembly means spaced outwardly from said stopping member and disposed above the floor, said latch assembly means also being horizontally movable toward said stopping member for selectively engaging one of said slot means for maintaining said door stopping member in a selected position until said latch assembly means is disengaged from said selected slot means, a shoulder portion disposed below said lower slot means for limiting the upward travel of said stopping member, and a spring means disposed below said stopping member for biasing said stopping member into a raised position.

8. A foot-operated door stop assembly as defined in claim 7 in which said latch assembly means includes a key which projects forwardly from one end of said latch assembly means for engagement with said upper and lower slot means, and a spring means disposed at an end of said latch assembly means opposite said key for urging said key into engagement with said upper and lower slot means.

* * * * *